US010300713B2

(12) United States Patent
Mizuno

(10) Patent No.: US 10,300,713 B2
(45) Date of Patent: May 28, 2019

(54) RECORDING APPARATUS

(71) Applicant: SEIKO EPSON CORPORATION, Tokyo (JP)

(72) Inventor: Takayoshi Mizuno, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/671,655

(22) Filed: Aug. 8, 2017

(65) Prior Publication Data

US 2018/0043704 A1 Feb. 15, 2018

(30) Foreign Application Priority Data

Aug. 9, 2016 (JP) ..... 2016-156220

(51) Int. Cl.

| | |
|---|---|
| ***B41J 2/01*** | (2006.01) |
| ***B41J 11/00*** | (2006.01) |
| ***B41M 7/00*** | (2006.01) |
| *B41J 2/165* | (2006.01) |

(52) U.S. Cl.

CPC ..... *B41J 11/002* (2013.01); *B41M 7/0072* (2013.01); *B41J 2/16511* (2013.01)

(58) Field of Classification Search

None

See application file for complete search history.

(56) References Cited

U.S. PATENT DOCUMENTS

| | | | | |
|---|---|---|---|---|
| 7,370,955 | B2 * | 5/2008 | Yokoyama | B41J 11/002 347/100 |
| 2003/0184631 | A1 * | 10/2003 | Suzuki | B41J 11/002 347/102 |
| 2005/0012778 | A1 | 1/2005 | Nishino et al. | |
| 2013/0100532 | A1 * | 4/2013 | Agashe | G02B 5/128 359/530 |
| 2015/0130880 | A1 * | 5/2015 | Schadt | B41F 23/0409 347/102 |

FOREIGN PATENT DOCUMENTS

| | | | |
|---|---|---|---|
| JP | 2004-167917 | A | 6/2004 |
| JP | 2004-314304 | A | 11/2004 |
| JP | 2005-053221 | A | 3/2005 |
| JP | 2010-269574 | A | 12/2010 |

* cited by examiner

*Primary Examiner* — Matthew Luu
*Assistant Examiner* — Tracey M McMillion
(74) *Attorney, Agent, or Firm* — Foley & Lardner LLP

(57) ABSTRACT

A recording apparatus includes a light irradiation unit configured to emit light for curing photocurable ink to a recording medium, and a head having a nozzle formation surface in which nozzles for discharging the photocurable ink onto the recording medium are formed. A retroreflection surface is provided on at least a part of a light arrival region at which the light emitted from the light irradiation unit arrives.

12 Claims, 8 Drawing Sheets

RECORDING APPARATUS

BACKGROUND

1. Technical Field

The present invention relates to a recording apparatus.

2. Related Art

As an example of a recording apparatus, an existing ink jet printer that includes a light irradiation unit which emits light for curing photocurable ink, and records (prints) images by discharging liquid droplets onto various recording media such as paper, a film and so on using the photocurable ink to form a plurality of dots on the recording media has been known. For example, JP-A-2004-167917 discloses an ink jet printer including a recording head that discharges ink which is cured by being irradiated with ultraviolet rays and an ultraviolet ray irradiation unit that has a cover member opened to a recording medium side. JP-A-2004-167917 describes that the ultraviolet rays reflected by the recording medium are not incident on the lower surface of the recording head by arranging the recording head and the cover member with a distance therebetween so as to satisfy a predetermined equation.

The recording apparatus as disclosed in JP-A-2004-167917 prevents regular reflected light that has been regularly reflected by the recording medium from being incident on a nozzle formation surface of the head. However, light that undergoes multiple reflection between the recording medium and the bottom surface of the light irradiation unit, which opposes the recording medium, and the like arrives at the nozzle formation surface in some case. Due to this, the photocurable ink which has adhered to nozzles formed in the nozzle formation surface is cured to cause a risk of discharge failure of the nozzles.

SUMMARY

An advantage of some aspects of the invention is to solve at least a part of the issues mentioned above and can be realized in the following modes or application examples.

Application Example 1

A recording apparatus according to Application Example 1 includes a light irradiation unit capable of emitting light for curing photocurable ink to a recording medium, and a head having a nozzle formation surface in which nozzles for discharging the photocurable ink onto the recording medium are formed, wherein a retroreflection surface is provided on at least a part of a light arrival region at which the light emitted from the light irradiation unit arrives.

With the configuration of Application Example 1, the recording apparatus includes the retroreflection surface on at least a part of the light arrival region at which the light emitted from the light irradiation unit directly arrives and indirectly arrives. An angle of reflection of light reflected by the retroreflection surface is equal to the angle of incidence of light that is incident on the retroreflection surface. That is to say, the retroreflection surface reflects light back in a direction that is opposite to and in parallel with the incident light. Therefore, the amount of the light for curing the photocurable ink, which arrives at the nozzle formation surface, can be reduced. This reduction suppresses discharge failure caused by curing of the photocurable ink which has adhered to the nozzles formed in the nozzle formation surface. Accordingly, the recording apparatus with improved discharge stability can be provided.

Application Example 2

In the recording apparatus according to the above application example, it is preferable that a shielding portion which reduces the light directing toward the nozzle formation surface be provided in the light arrival region.

With the configuration of Application Example 2, the recording apparatus includes the shielding portion which reduces the light emitted from the light irradiation unit and directing toward the nozzle formation surface. Therefore, the amount of the light for curing the photocurable ink, which arrives at the nozzle formation surface, can be reduced.

Application Example 3

In the recording apparatus according to the above application example, it is preferable that the retroreflection surface be provided on at least a part of a surface opposing the light irradiation unit in a region interposed between the light irradiation unit and the head.

With the configuration of Application Example 3, the retroreflection surface can reflect the light that has arrived directly and indirectly from the light irradiation unit side to the light irradiation unit side because it is provided on the surface opposing the light irradiation unit in the region interposed between the light irradiation unit and the head. Therefore, the amount of the light for curing the photocurable ink, which arrives at the nozzle formation surface, can be reduced.

Application Example 4

In the recording apparatus according to the above application example, it is preferable that a light absorbing surface which absorbs the light be provided on at least a part of a surface opposing the head in the interposed region.

With the configuration of Application Example 4, the light absorbing surface which absorbs the light is provided on the surface opposing the head in the region interposed between the light irradiation unit and the head. The energy of the light that has been emitted from the light irradiation unit and has arrived at the surface opposing the head after passing through between the head (nozzle formation surface) and the recording medium attenuates with the light absorbing surface, thereby reducing the light directing toward the head due to irregular reflection or the like. Therefore, the amount of the light for curing the photocurable ink, which arrives at the nozzle formation surface, can be reduced.

Application Example 5

In the recording apparatus according to the above application example, it is preferable that the shielding portion be arranged between the light irradiation unit and the head.

With the configuration of Application Example 5, the shielding portion which reduces the light directing toward the nozzle formation surface is provided between the light irradiation unit and the head. Therefore, the amount of the light for curing the photocurable ink, which arrives at the nozzle formation surface, can be reduced.

Application Example 6

In the recording apparatus according to the above application example, it is preferable that at least a part of a housing of the light irradiation unit falls within the light arrival region.

With the configuration of Application Example 6, at least a part of the housing of the light irradiation unit falls within the light arrival region. That is to say, at least a part of the housing of the light irradiation unit has the retroreflection surface. With this, the light that has been emitted from a light source of the light irradiation unit and has arrived at the housing of the light irradiation unit after being reflected by the surface of the recording medium, and the like undergoes retroreflection and directs toward the light source direction of the light irradiation unit through the reflection surface such as the recording medium and the like. Therefore, the amount of the light for curing the photocurable ink, which arrives at the nozzle formation surface, can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
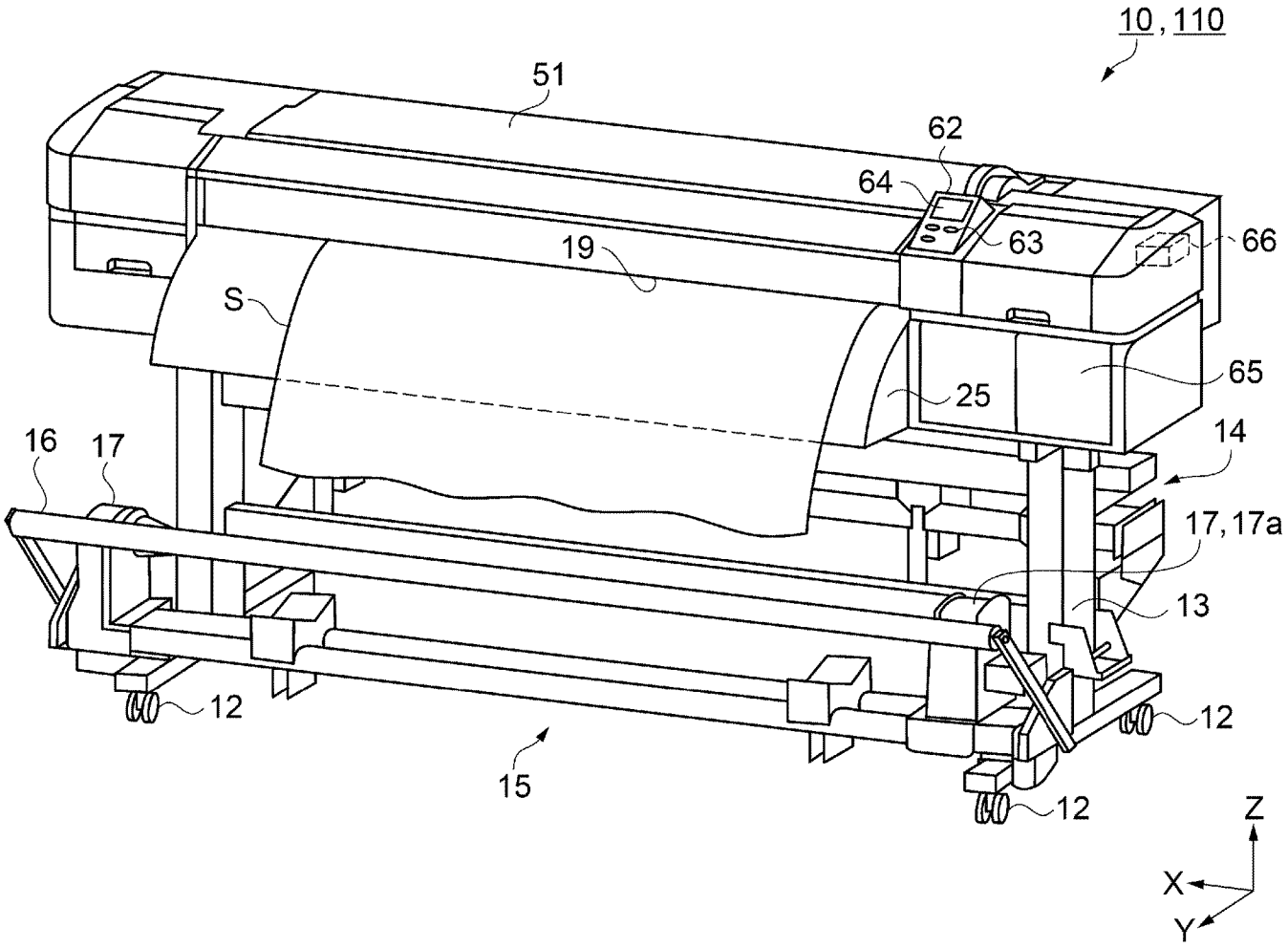
FIG. 1 is a perspective view illustrating the schematic configuration of a recording apparatus according to a first embodiment.

Hereinafter, embodiments of the invention will be described with reference to the drawings. In the following drawings, scales of respective members and the like are made different from actual scales thereof in order to make the respective members and the like have sizes capable of being recognized in the drawings.

In FIG. 1 to FIG. 10, an X axis, a Y axis, and a Z axis are illustrated as three axes orthogonal to one another for the convenience of description. A tip side of each arrow indicating an axial direction in the drawings is set to a "+ side" and a base end side thereof is set to a "− side". A direction that is parallel with the X axis is set to an "X-axis direction", a direction that is parallel with the Y axis is set to a "Y-axis direction", and a direction that is parallel with the Z axis is set to a "Z-axis direction".

First Embodiment

A recording apparatus that is described in the embodiment is, for example, an ink jet printer. In the embodiment, a roll-to-roll large format printer (LFP) handling relatively large-sized media (recording media) is described as an example of the configuration of the recording apparatus. It should be noted that in the embodiment, photocurable ink that is to be cured by being irradiated with light is used.

Configuration of Recording Apparatus

Figure 2:
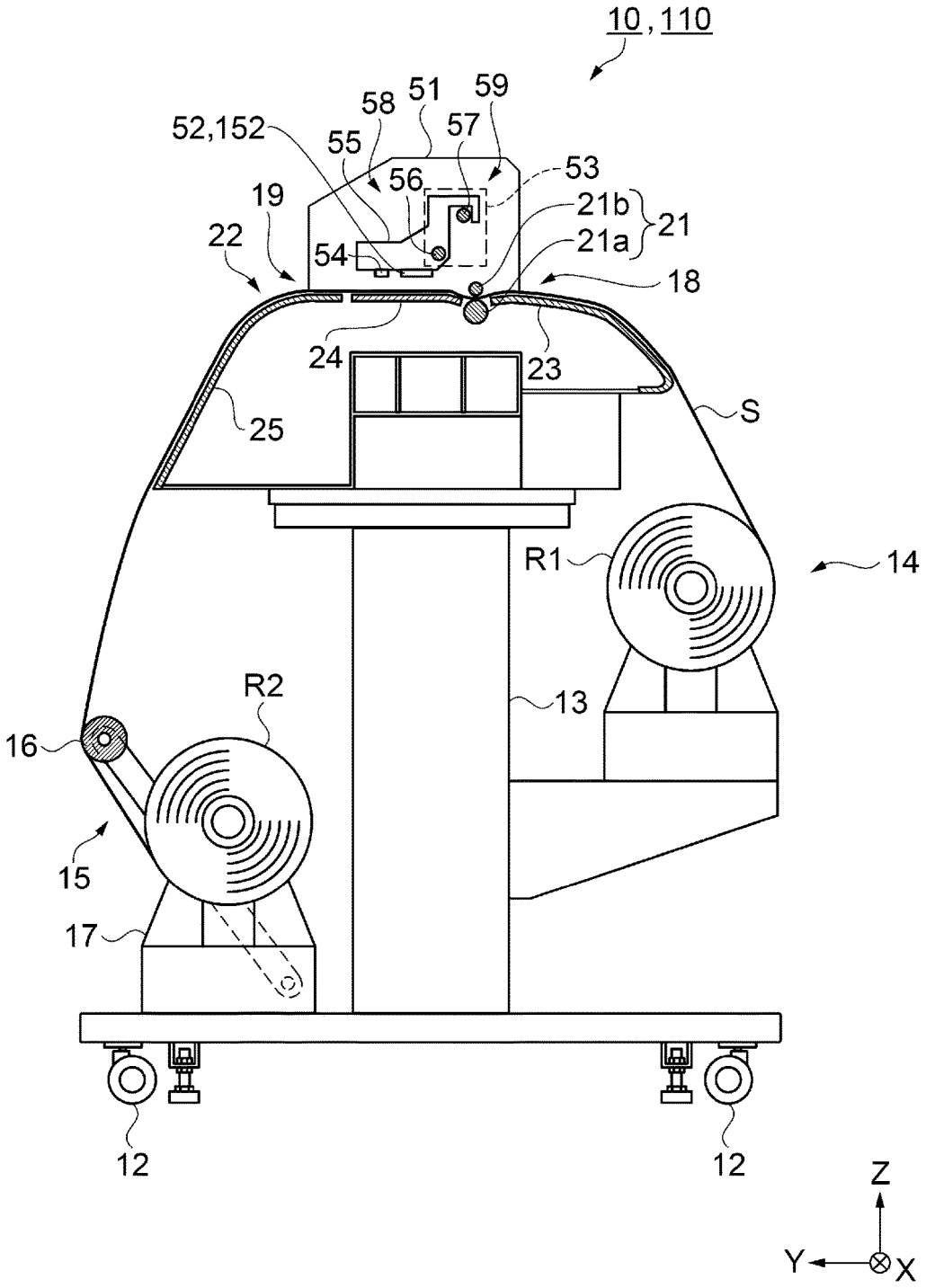
FIG. 2 is a cross-sectional view illustrating the internal configuration of the recording apparatus.

FIG. 1 is a perspective view illustrating the schematic configuration of a recording apparatus according to the first embodiment. FIG. 2 is a cross-sectional view illustrating the internal configuration of the recording apparatus. The configuration of a recording apparatus 10 will be described with reference to FIG. 1 and FIG. 2.

As illustrated in FIG. 1 and FIG. 2, the recording apparatus 10 includes a transportation roller pair 21, a medium supply unit 14, a printing unit 58, and a medium winding unit 15. The transportation roller pair 21 transports a recording medium S in the transportation direction. The medium supply unit 14 supplies the recording medium S of a roll body to the transportation roller pair 21. The printing unit 58 performs printing on the recording medium S that is transported. The medium winding unit 15 winds the recording medium S on which printing has been performed into a roll form. The printing unit 58 is provided in a housing portion 51 having a substantially rectangular parallelepiped shape. The respective parts are supported on a pair of leg portions 13 on which wheels 12 are mounted on the lower ends. In the embodiment, the up-down direction along the gravity force direction corresponds to the Z axis and the +Z-axis side is set to the "upper" side. The lengthwise direction (right-left direction) of the housing portion 51, which intersects with the Z-axis direction, corresponds to the X axis and the +X-axis side is set to the "left" side. Furthermore, the direction (front-rear direction) intersecting with both of the Z-axis direction and the X-axis direction corresponds to the Y axis and the +Y-axis side is set to the "front" side. A positional relation of the recording medium S along the transportation direction is also expressed as an "upstream side" and a "downstream side".

The medium supply unit 14 is provided at the rear side (−Y-axis direction side) relative to the housing portion 51. The medium supply unit 14 holds a roll body R1 formed by winding the unused recording medium S in a cylindrical form. It should be noted that any of the roll bodies R1 of a plurality of different sizes having different widths (lengths in the X-axis direction) of the recording media S and the different number of windings thereof is loaded in the medium supply unit 14 in a replaceable manner. Regardless of its size, the roll body R1 is loaded in the medium supply unit 14 in a state of being close to an end portion at the right side (−X-axis side). The recording medium S is unwound from the roll body R1 to be fed to the printing unit 58 by rotating the medium supply unit 14 in which the roll body R1 is loaded in the counterclockwise direction in FIG. 2. In the embodiment, the roll body R1 formed by winding the recording medium S while a print surface thereof on which printing is performed faces outward is employed. Types of the recording media S that are used in the recording apparatus 10 are roughly classified into a paper type and a film type. Specific examples thereof include high-quality paper, cast paper, art paper, coated paper, and the like as the paper type, and a synthetic film, polyethylene terephthalate (PET), polypropylene (PP), and the like as the film type.

The medium winding unit 15 is provided at the front side (+Y-axis direction side) relative to the housing portion 51. A roll body R2 is formed in the medium winding unit 15 by winding the recording medium S on which printing has been performed by the printing unit 58 in a cylindrical form. The medium winding unit 15 includes a pair of holders 17 holding therebetween a core member for winding the recording medium S and forming the roll body. One holder 17*a* includes a winding motor (not illustrated) supplying rotating force to the core member. The recording medium S is wound around the core member to form the roll body R2 when the winding motor is driven to cause the core member to rotate. The medium winding unit 15 includes a tension roller 16 that presses the back surface side of the recording medium S drooping with its own weight and applies tensile force to the recording medium S which is wound by the medium winding unit 15.

In the recording apparatus 10 in the embodiment, the recording medium S can also be discharged without being wound as the roll body R2. For example, the recording medium S after being printed can also be accommodated in a discharge basket (not illustrated) mounted instead of the medium winding unit 15.

The recording apparatus 10 includes an upstream-side support portion 23, a platen 24, and a downstream-side support portion 25 that support the recording medium S which is transported by the transportation roller pair 21 from the lower side (−Z-axis side). The upstream-side support portion 23 is provided at the rear side (−Y-axis side) relative to the housing portion 51 and guides the recording medium S that is supplied from the medium supply unit 14 to the transportation roller pair 21. The platen 24 is provided at a position opposing the printing unit 58 and supports the recording medium S on which printing is being performed. The downstream-side support portion 25 is provided at the front side (+Y-axis side) relative to the housing portion 51 and guides the recording medium S on which printing has been performed to the medium winding unit 15 from the platen 24. The upstream-side support portion 23, the platen 24, and the downstream-side support portion 25 configure a transportation path 22 of the recording medium S.

The transportation roller pair 21 extends in the direction intersecting with the transportation direction of the recording medium S and is provided between the platen 24 and the upstream-side support portion 23. The transportation roller pair 21 includes a transportation driving roller 21*a* and a transportation driven roller 21*b*. The transportation driving roller 21*a* is arranged under the transportation path 22 and is rotationally driven. The transportation driven roller 21*b* is arranged above the transportation driving roller 21*a* and rotates while following the rotation of the transportation driving roller 21*a*. The transportation driven roller 21*b* is configured to be movable so as to be separated from or make pressure contact with the transportation driving roller 21*a*. In a state in which the transportation driving roller 21*a* and the transportation driven roller 21*b* make pressure contact with each other, the transportation roller pair 21 holds (nips) the recording medium S therebetween and feeds it to the printing unit 58 in the transportation direction (+Y-axis direction). A transportation motor (not illustrated) as a driving source that outputs rotation driving force to the transportation driving roller 21*a* is provided in the housing portion 51. When the transportation motor is driven and the transportation driving roller 21*a* is rotationally driven, the recording medium S held between the transportation driven roller 21*b* and the transportation driving roller 21*a* is transported in the transportation direction (+Y-axis direction).

An operation panel 62 is provided in an upper portion of the housing portion 51 at the −X-axis direction side. The operation panel 62 includes a display unit 64 and an operation unit 63. A print condition setting screen and the like are displayed on the display unit 64. The operation unit 63 is operated when print conditions and the like are input and various instructions are given. An ink attachment portion 65 to which ink storage containers (ink cartridges) (not illustrated) capable of storing therein inks can be attached is provided in a lower portion of the housing portion 51 at the −X-axis direction side. A plurality of ink cartridges are attached to the ink attachment portion 65 so as to be compatible with types and colors of the inks. Furthermore, a controller 66 that controls operations of devices included in the respective units of the recording apparatus 10 is provided in the housing portion 51.

The housing portion 51 includes the printing unit 58. A supply port 18 for supplying the recording medium S to the printing unit 58 is formed at a position above the upstream-side support portion 23 at the rear surface side (−Y-axis side) relative to the housing portion 51. A discharge port 19 for discharging the recording medium S on which printing has been performed by the printing unit 58 is formed at a position above the downstream-side support portion 25 at the front surface side (+Y-axis side) relative to the housing portion 51.

The printing unit 58 is arranged at the upper side (+Z-axis side) relative to an arrangement position of the platen 24, and is provided so as to be movable in the width direction of the recording medium S. The printing unit 58 includes a head unit 52, a carriage 55, a head movement unit 59, and the like. The head unit 52 discharges the inks onto the recording medium S that is fed from the medium supply unit 14 and is transported along the upstream-side support portion 23 and the platen 24. The head unit 52 is mounted on the carriage 55. The head movement unit 59 moves the carriage 55 in the main-scanning direction (X-axis direction) intersecting with the transportation direction.

The head movement unit 59 moves the carriage 55 (head unit 52) in the main-scanning direction. The carriage 55 is supported on guide rails 56 and 57 arranged along the X-axis direction and is configured so as to be able to reciprocate in the ±X-axis direction by the head movement unit 59. As a mechanism of the head movement unit 59, for example, a mechanism configured by combining a ball spring and a ball nut, a linear guide mechanism, or the like can be employed. Furthermore, a motor (not illustrated) is provided as a driving source for moving the carriage 55 along the X-axis direction in the head movement unit 59. When the motor is driven under the control of the controller 66, the head unit 52 reciprocates along the X-axis direction together with the carriage 55.

Adjustment mechanisms 53 that change the height (position in the Z-axis direction) of the head unit 52 for adjusting a separation distance between the head unit 52 and the recording medium S are provided in both of end portions of the guide rails 56 and 57 in the X-axis direction. Furthermore, a reflection-type sensor 54 that detects the paper width (width in the X-axis direction) of the recording medium S is held on a lower portion of the carriage 55 at a position at the downstream side (+Y-axis side) relative to the head unit 52 in the transportation direction.

The reflection-type sensor 54 is an optical sensor including a light source unit and a light receiving unit (not illustrated). The reflection-type sensor 54 receives, by the light receiving unit, reflected light of light emitted downward from the light source unit and outputs, to the controller 66, a detection value (voltage value) in accordance with the intensity of the reflected light received by the light receiving unit. Furthermore, the width (length in the X-axis direction) of the recording medium S is calculated by detecting the reflected light by the reflection-type sensor 54 while moving the carriage 55 in the main-scanning direction and detecting, by the controller 66, varying positions of a reflection target, that is, positions of both of the end portions of the recording medium S in the X-axis direction based on the detection values. Then, the head unit 52 ejects the inks supplied from the ink storage containers onto the recording medium S that is transported along the transportation path 22 in accordance with the detected width of the recording medium S for printing. The recording medium S after being printed is guided obliquely downward along the downstream-side support portion 25 and is wound by the medium winding unit 15.

Although in the embodiment, the configuration of the recording apparatus 10 that supplies the long recording medium S with the roll-to-roll system has been described, the configuration of the recording apparatus 10 is not limited thereto. For example, the recording apparatus may have the configuration that supplies cutform paper formed by cutting long paper into a predetermined length in a sheet-fed manner or may have the configuration in which the recording medium S after being printed is accommodated in a discharge basket (not illustrated) mounted instead of the medium winding unit 15.

Configuration of Head Unit

Figure 3:
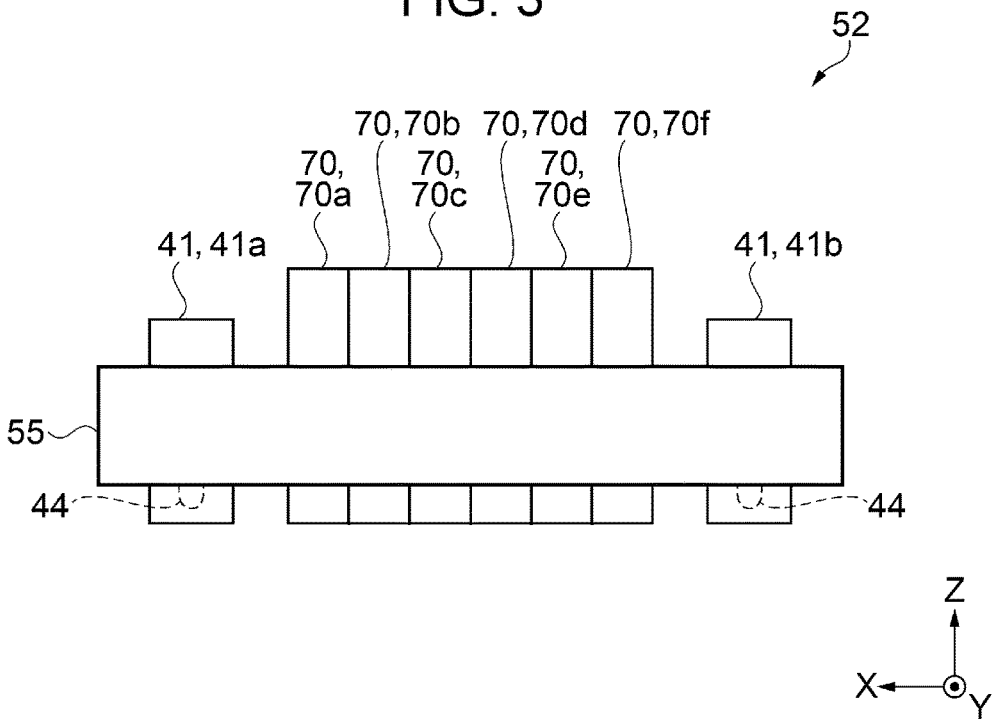
FIG. 3 is a side view illustrating the configuration of a head unit.
Figure 4:
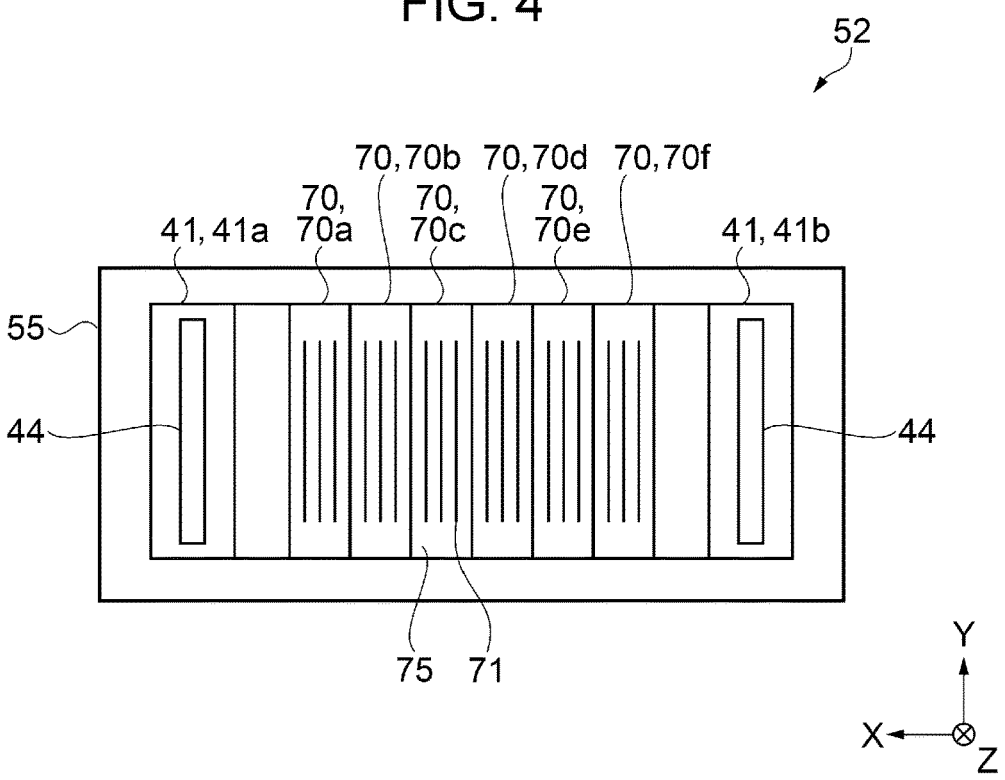
FIG. 4 is a plan view illustrating the configuration of the head unit.
Figure 5:
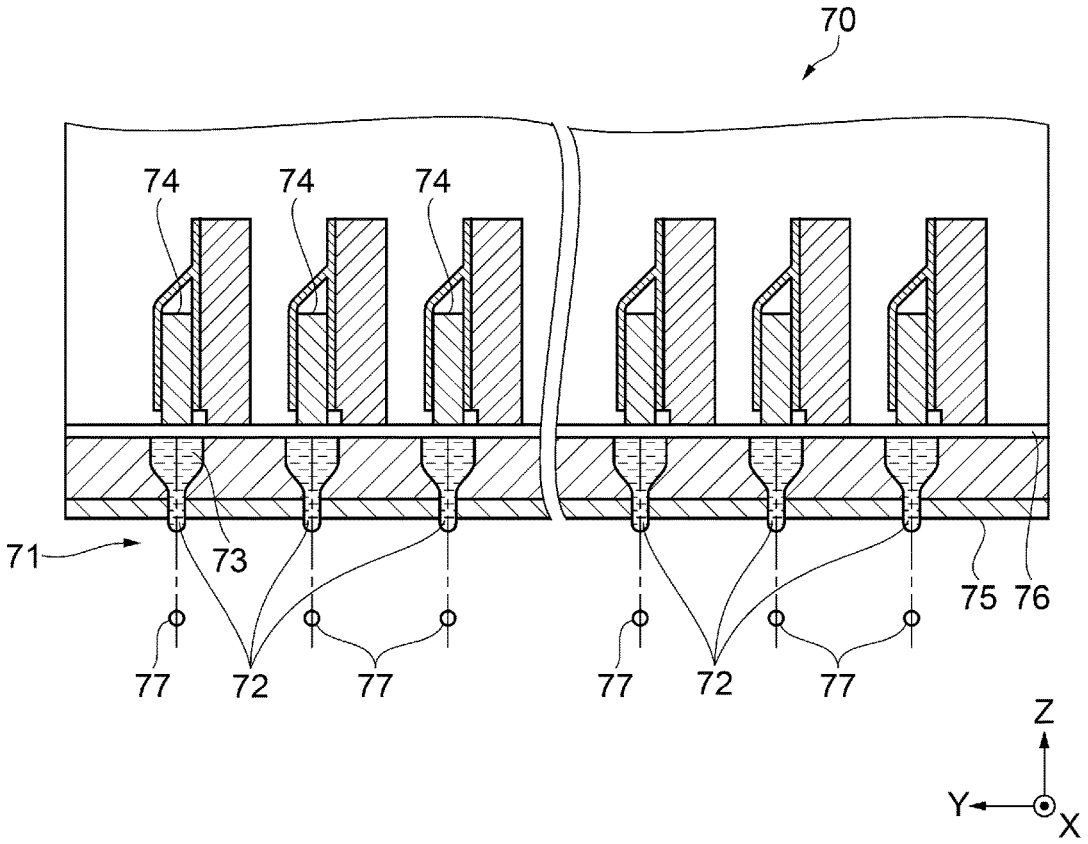
FIG. 5 is a cross-sectional view illustrating the internal configuration of a head.

FIG. 3 is a side view illustrating the configuration of the head unit. FIG. 4 is a plan view illustrating the configuration of the head unit. FIG. 5 is a cross-sectional view illustrating the internal configuration of a head. FIG. 4 illustrates the head unit 52 when seen from the lower side (−Z-axis side). The configuration of the head unit 52 is described with reference to FIG. 3 to FIG. 5.

As illustrated in FIG. 3 and FIG. 4, the head unit 52 includes six heads 70 (70*a* to 70*f*) and two light irradiation units 41 (41*a* and 41*b*), and is supported on the carriage 55. The six heads 70*a* to 70*f* are aligned in the X-axis direction. The light irradiation unit 41*a* is arranged at the outer side (+X-axis side) of the head 70*a* and the light irradiation unit 41*b* is arranged at the outer side (−X-axis side) of the head 70*f*. That is to say, the two light irradiation units 41*a* and 41*b* are provided at positions opposing each other with the heads 70*a* to 70*f* interposed therebetween in the X-axis direction.

The respective heads 70*a* to 70*f* include nozzles 72 (see FIG. 5) for discharging the photocurable ink that is cured by being irradiated with light containing ultraviolet rays onto the recording medium S, for example. To be specific, the heads 70 include nozzle formation surfaces 75 in which the nozzles 72 are formed on the lower surface (surface at the −Z-axis direction side). Nozzle rows 71 formed by the plurality of nozzles 72 aligned in the Y-axis direction are formed in the nozzle formation surfaces 75.

The respective heads 70*a* to 70*f* discharge inks of, for example, white, yellow, cyan, magenta, black, and clear (transparent), respectively, in this order. The head 70*a* that discharges the white ink is used for forming a white background on the recording medium S when an image is printed on the transparent recording medium S. To be specific, the head 70*a* forms the background by discharging the white ink so as to fill the entire surface of a region as an image formation target. The head 70*b* to the head 709*e* that discharge the inks of yellow, cyan, magenta, and black, respectively, form a color image in a superimposed manner on the white background. The head 70*f* discharges the clear ink on the color image in a superimposed manner to cover the color image with the clear ink. With the clear ink, texture such as glossy feeling and matte feeling can be added to the color image.

The photocurable ink contains a resin material, a photopolymerization initiator, and a solvent as components. Ink having unique functions can be generated by adding a coloring matter such as a pigment and a dye and a functional material such as a surface modifier having lyophilic property, liquid repellent property, or the like to these components. The inks of yellow, cyan, magenta, and black, that form the color image contain the added coloring matters such as the pigments and the dyes.

The resin material is a material forming a resin film. The resin material is not particularly limited as long as it is a material that is in a liquid state at a normal temperature and becomes a polymer by polymerization. As the resin material, a material having low viscosity is preferable and a material in an oligomer form is preferable. Furthermore, the resin material in a monomer form is more preferable.

The photopolymerization initiator is an additive that progresses a crosslinking reaction while interacting with a crosslinking group of the polymer. As the photopolymerization initiator, for example, benzine dimethylketal or the like is added.

The solvent adjusts the viscosity of the resin material.

The light irradiation units 41 have light sources 44 each of which emits light for curing the photocurable ink onto the recording medium S. As the light sources 44, for example, various light sources such as a light emitting diode (LED), a laser diode (LD), a mercury lamp, a metal halide lamp, a xenon lamp, an excimer lamp, and so on can be used. The lengths of the light sources 44 in the Y-axis direction are set to the lengths covering the nozzle rows 71 provided in the heads 70.

The number of heads that are provided in the head unit and the type of the inks that are discharged from the heads are examples and are not limited to those described above. Furthermore, although the light irradiation units 41 are arranged at the outer sides of the heads 70*a* to 70*f*, the light irradiation units may be provided between the head and the head.

As illustrated in FIG. 5, each head 70 includes the nozzle formation surface 75 and the nozzles 72 are formed in the nozzle formation surface 75. Cavities 73 communicating with the nozzles 72 are formed at the upper side (+Z-axis side) of the nozzle formation surface 75 at positions corresponding to the nozzles 72. The ink stored in the ink cartridge is supplied to the cavities 73 for the nozzles 72.

A vibration plate 76 and piezoelectric elements 74 are installed at the upper side (+Z-axis side) of the cavities 73. The vibration plate 76 vibrates in the up-down direction (±Z-axis direction) to increase and decrease volumes in the cavities 73. The piezoelectric elements 74 expand and contract in the up-down direction to cause the vibration plate 76 to vibrate. When the piezoelectric elements 74 expand and contract in the up-down direction to cause the vibration plate 76 to vibrate and the vibration plate 76 increases and decreases the volumes in the cavities 73, the cavities 73 are pressurized. With this, pressures in the cavities 73 vary and the ink supplied into the cavities 73 is discharged through the nozzles 72.

When each head 70 receives a driving signal for controlling and driving the piezoelectric elements 74, which has been generated by the controller 66, the piezoelectric elements 74 expand and the vibration plate 76 decreases the volumes in the cavities 73. As a result, the ink for the amounts of the reduced volumes is discharged through the nozzles 72 as liquid droplets 77. Although in the embodiment, pressurizing units using the longitudinal-vibration-type piezoelectric elements 74 are described, the pressurizing units are not limited thereto. For example, deflection-deformable-type piezoelectric elements configured by laminating lower electrodes, piezoelectric layers, and upper electrodes may be used. Furthermore, as a pressure generation unit, a so-called electrostatic actuator that generates static electricity between the vibration plate and the electrodes, deforms the vibration plate with electrostatic force, and causes liquid droplets to be discharged through the nozzles may be used. Moreover, a head having the configuration in which bubbles are generated in the nozzles using heat generation bodies and inks are discharged as liquid droplets with the bubbles may be used.

Figure 10:
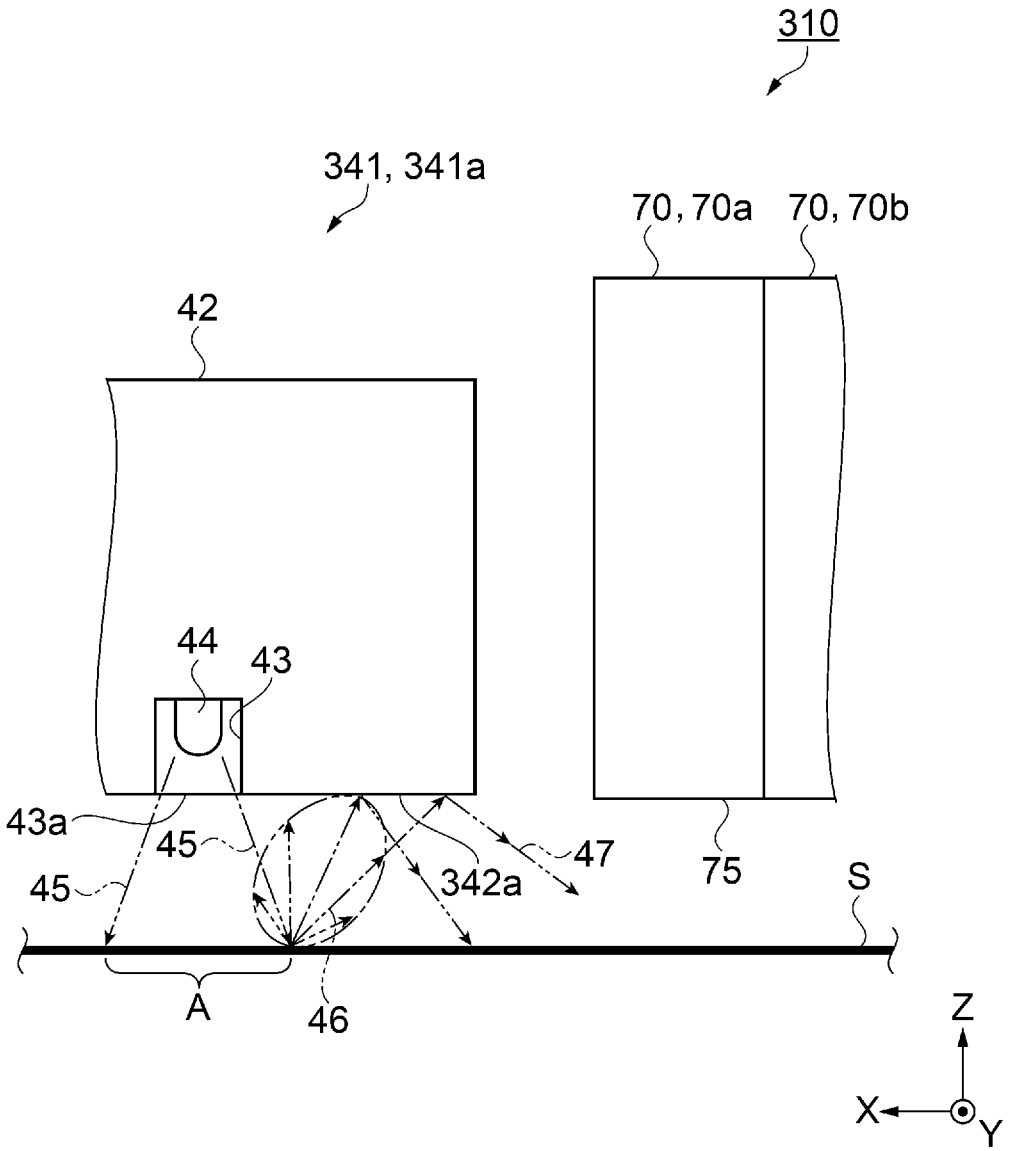
FIG. 10 is a side view illustrating a main part of a head unit having the existing configuration in an enlarged manner.

FIG. 10 is a side view illustrating a main part of a head unit having the existing configuration in an enlarged manner. Propagation of light that is emitted from each of light irradiation units 341 of a recording apparatus 310 having the existing configuration will be described with reference to FIG. 10. It should be noted that in FIG. 10, light propagation images are indicated by arrows with two-dot chain lines.

An accommodation portion 43 accommodating therein the light source 44 is provided in the housing 42 of each light irradiation unit 341. The accommodation portion 43 is formed to have a recess shape and has an opening 43*a* opened in a slit-like form in a bottom surface 342*a* (surface at the −Z-axis side) opposing the recording medium S. The opening 43*a* is closed by a member such as glass transmitting light. The light source 44 is provided on the inner bottom surface of the accommodation portion 43 and can emit light toward the photocurable ink discharged onto the recording medium S. The light source 44 is accommodated in the accommodation portion 43 having the recess shape to narrow an irradiation region A with irradiation light 45 emitted from the light source 44 by the slit-like opening 43*a*. That is to say, the light can be emitted to the recording medium S in a range of the irradiation region A in order to cure the photocurable ink.

The irradiation light 45 emitted to the irradiation region A is reflected by the surface of the recording medium S while being converted into reflected light. FIG. 10 illustrates images of medium reflected light 46 after regular reflection and irregular reflection of the irradiation light 45 that has arrived at one end of the irradiation region A at the −X-axis side by the surface of the recording medium S and housing reflected light 47 after arrival and regular reflection of a part of the medium reflected light 46 at and by the bottom surface 342*a* of the housing 42. Actually, the light amount attenuates because the medium reflected light 46 is also irregularly reflected by the bottom surface 342*a* of the housing 42. In this manner, the light emitted from each of the light sources 44 propagates in the X-axis direction while being repeatedly reflected between the recording medium S and the bottom surfaces 342*a* of the housings 42 of the light irradiation units 341 and between the recording medium S and the nozzle formation surfaces 75 of the heads 70. With this, the light emitted from each of the light irradiation units 41 arrives at the nozzle formation surfaces 75 and the photocurable ink which has adhered to the nozzles 72 formed in the nozzle formation surfaces 75 is cured, resulting in a risk of discharge failure of the nozzles 72.

Figure 6:
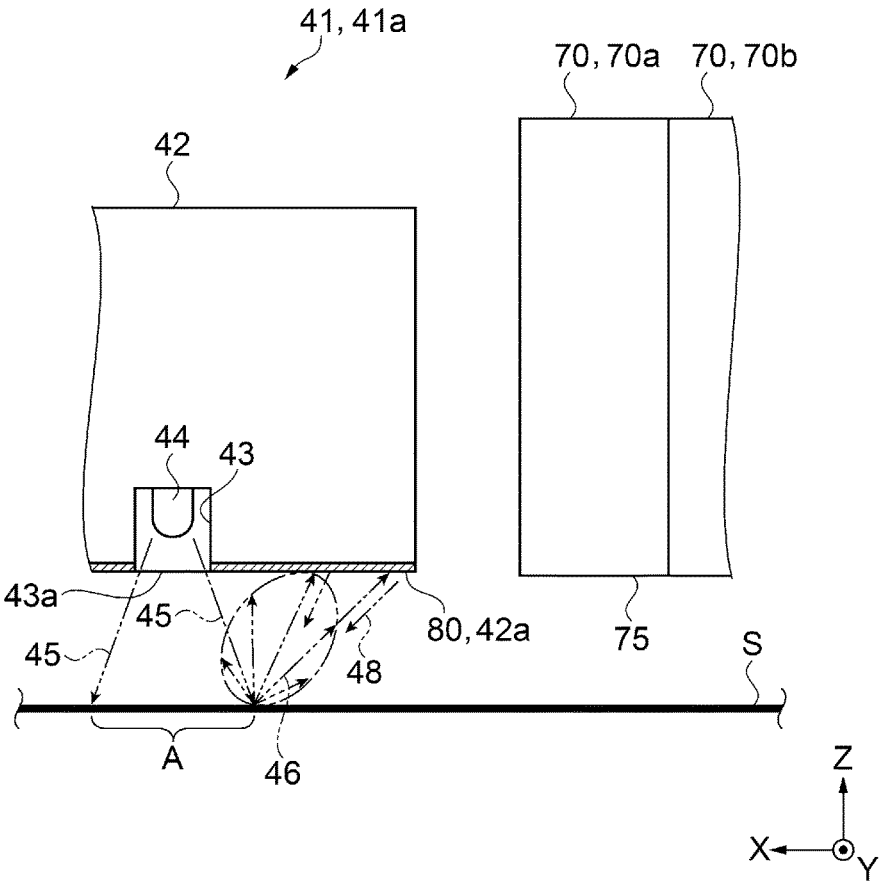
FIG. 6 is a side view illustrating a main part of the head unit in an enlarged manner.
Figure 7:
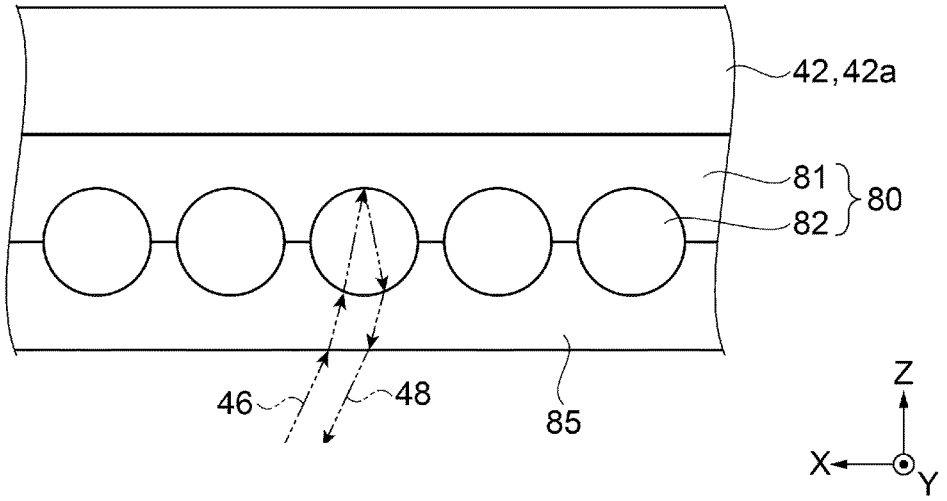
FIG. 7 is a view for explaining the configuration of a retroreflection surface.

FIG. 6 is a side view illustrating a main part of the head unit in the embodiment in an enlarged manner. FIG. 7 is a view for explaining the configuration of a retroreflection surface. The configuration of the light irradiation units 41 and propagation of the light emitted from each of the light irradiation units 41 will be described with reference to FIG. 6 and FIG. 7. It should be noted that in FIG. 6, light propagation images are indicated by arrows with two-dot chain lines.

As illustrated in FIG. 6, the housing 42 of each light irradiation unit 41 is formed by cutting an aluminum material, for example, and the accommodation portion 43 accommodating therein the light source 44 is provided in the bottom surface (surface at the −Z-axis side) of the housing 42, which opposes the recording medium S. In the recording apparatus 10 in the embodiment, retroreflection surfaces 80 are provided on at least a part of a light arrival region at which the light emitted from each of the light irradiation units 41 arrives. As described above, the light emitted from each of the light irradiation units 41 propagates in the X-axis direction while being repeatedly reflected. Therefore, the light arrival region can include locations at which the light propagates by being repeatedly reflected. That is to say, from one end side of the light irradiation unit 41*b* to the other end side of the light irradiation unit 41*a* can be considered as the light arrival region because it is possible that the light emitted from the light irradiation unit 41*a* arrives at one end side (−X-axis side) of the light irradiation unit 41*b* (see FIG. 3) and the light emitted from the light irradiation unit 41*b* arrives at the other end side (+X-axis side) of the light irradiation unit 41*a*. Furthermore, at least a part of the housings 42 of the light irradiation units 41 falls within the light arrival region and, in some embodiments, the retroreflection surfaces 80 are provided on the bottom surfaces 42*a* of the housings 42 of the light irradiation units 41. In certain embodiments, the retroreflection surfaces each include one or more retroreflector elements.

For example, as illustrated in FIG. 7, each retroreflection surface 80 is configured by a resin layer 81, glass beads 82, a reflection layer (not illustrated) arranged between the resin layer 81 and the glass beads 82, and the like. Acrylic resin, urethane resin, or the like is used for the resin layer 81 and a reflecting material (not illustrated) made of mica or the like as a raw material is uniformly added thereto. The glass beads 82 form substantially perfectly round spheres each having a refractive index of approximately 2.0 and a diameter of approximately 100 μm and parts thereof are exposed to the surface of the resin layer 81. The retroreflection surfaces 80 are formed by applying retroreflection coating to the bottom surfaces 42*a* of the housings 42. As the retroreflection coating, for example, "Bright coat N black" manufactured by Komatsu Process Corporation, and the like, has been known. It should be noted that the retroreflection surfaces 80 may be formed by bonding retroreflection sheets to the bottom surfaces 42*a* of the housings 42. As the retroreflection sheets, for example, "Oralite 5200-010 white" manufactured by ORAFOL Europe GmbH, and the like, has been known.

The retroreflection surfaces 80 in the embodiment are covered by protection layers 85 protecting the surfaces (surfaces at the −Z-axis side). The protection layers 85 are formed by applying fluororesin clear coating. As the fluororesin clear coating, "BONNFLON #2050SR clear" manufactured by AGC COAT-TECH Co., Ltd, and the like, has been known. The irregular surfaces with projection of the glass beads 82 can be made smooth surfaces by covering the retroreflection surfaces 80 with the protection layers 85. With this, ink droplets (ink mist), cured products of the ink droplets, and the like that have adhered to the retroreflection surfaces 80 (protection layers 85) can be wiped off with ease.

The retroreflection surfaces 80 are not limited to be configured by using the glass beads 82 and may be configured by using corner cube mirrors or corner cube prisms.

Furthermore, air layers may be provided between the protection layers 85 and the glass beads 82.

Each of the glass beads 82 functions as a kind of a convex lens. The light such as the medium reflected light 46, which has been incident on the glass bead 82 after passing through the protection layer 85, is refracted, passes through the inside of the glass bead 82, and is focused on one point of a bottom portion of the sphere. Then, the light reflected by the reflection material covering the bottom portion of the sphere passes through the inside of the glass bead 82 again, is refracted when outputting from the glass bead 82 and the protection layer 85, and is returned to the incident direction as the light (retroreflected light 48) that is parallel with the medium reflected light 46. That is to say, the incident light that has been emitted from each of the light sources 44 is reflected to the light source 44 side. With this propagation manner, it is difficult for the light to diffuse in directions other than the incident direction, and propagate toward the nozzle formation surfaces. Accordingly, the amount of the light that is emitted from each of the light irradiation units 41 and cures the photocurable ink, which arrives at the nozzle formation surfaces 75, can be reduced. This reduction can suppress discharge failure caused by curing of the photocurable ink which has adhered to the nozzles 72 formed in the nozzle formation surfaces 75. Furthermore, the number of times of maintenance involving stoppage of the operation of the recording apparatus 10 can be reduced, thereby improving production efficiency of the recording apparatus 10. The light that has been reflected by the recording medium S in the irradiation region A, or the like, and has arrived at the retroreflection surface 80 is reflected by the retroreflection surface 80 and the recording medium S in the irradiation region A, or the like is irradiated with the retroreflected light 48 after the reflection, again. Therefore, usage efficiency of the light that is emitted to the irradiation region A for curing the photocurable ink is increased. In addition, the usage efficiency of the light that is emitted from each of the light sources 44 is increased, thereby reducing the amount of the light that is output. Accordingly, power consumption of the recording apparatus 10 can be lowered.

As described above, the recording apparatus 10 in the embodiment can provide the following effects.

In the recording apparatus 10, the retroreflection surfaces 80 are provided on the bottom surfaces 42*a* of the housings 42 of the light irradiation units 41 as at least a part of the light arrival region. The light such as the medium reflected light 46, which has been emitted from each of the light sources 44 and has been incident on the retroreflection surface 80, is returned to the light source 44 side in the form of the retroreflected light 48. Therefore, the amount of the light that arrives at the nozzle formation surfaces 75 is reduced. This reduction can suppress discharge failure caused by curing of the photocurable ink which has adhered to the nozzles 72 formed in the nozzle formation surfaces 75. Accordingly, the recording apparatus 10 with improved discharge stability can be provided.

Second Embodiment

Figure 8:
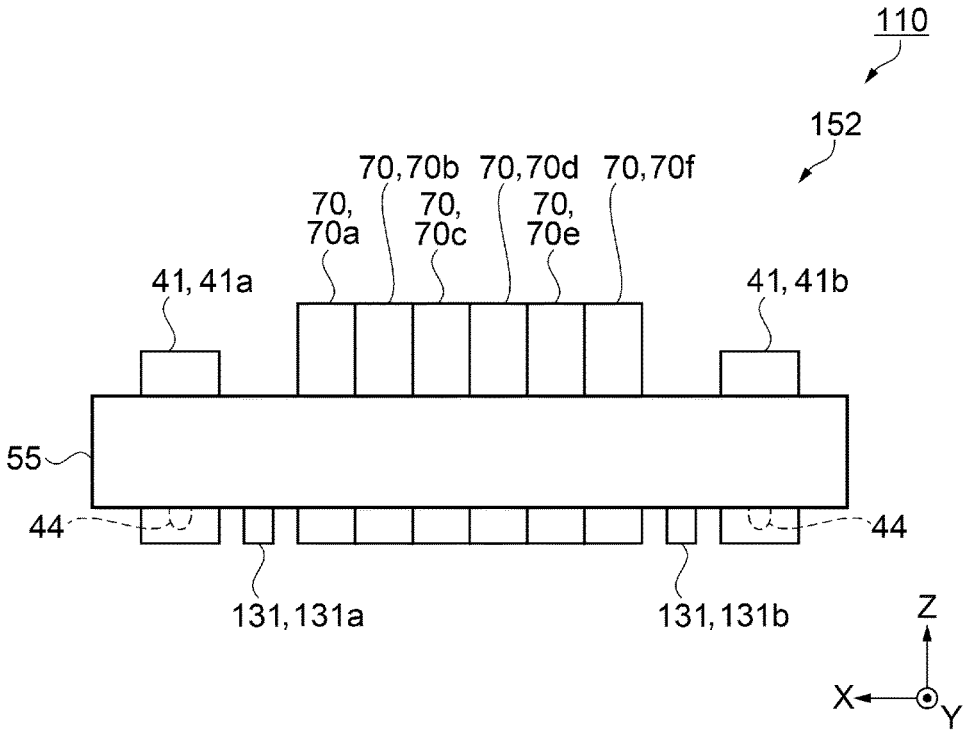
FIG. 8 is a side view illustrating the configuration of a head unit according to a second embodiment.
Figure 9:
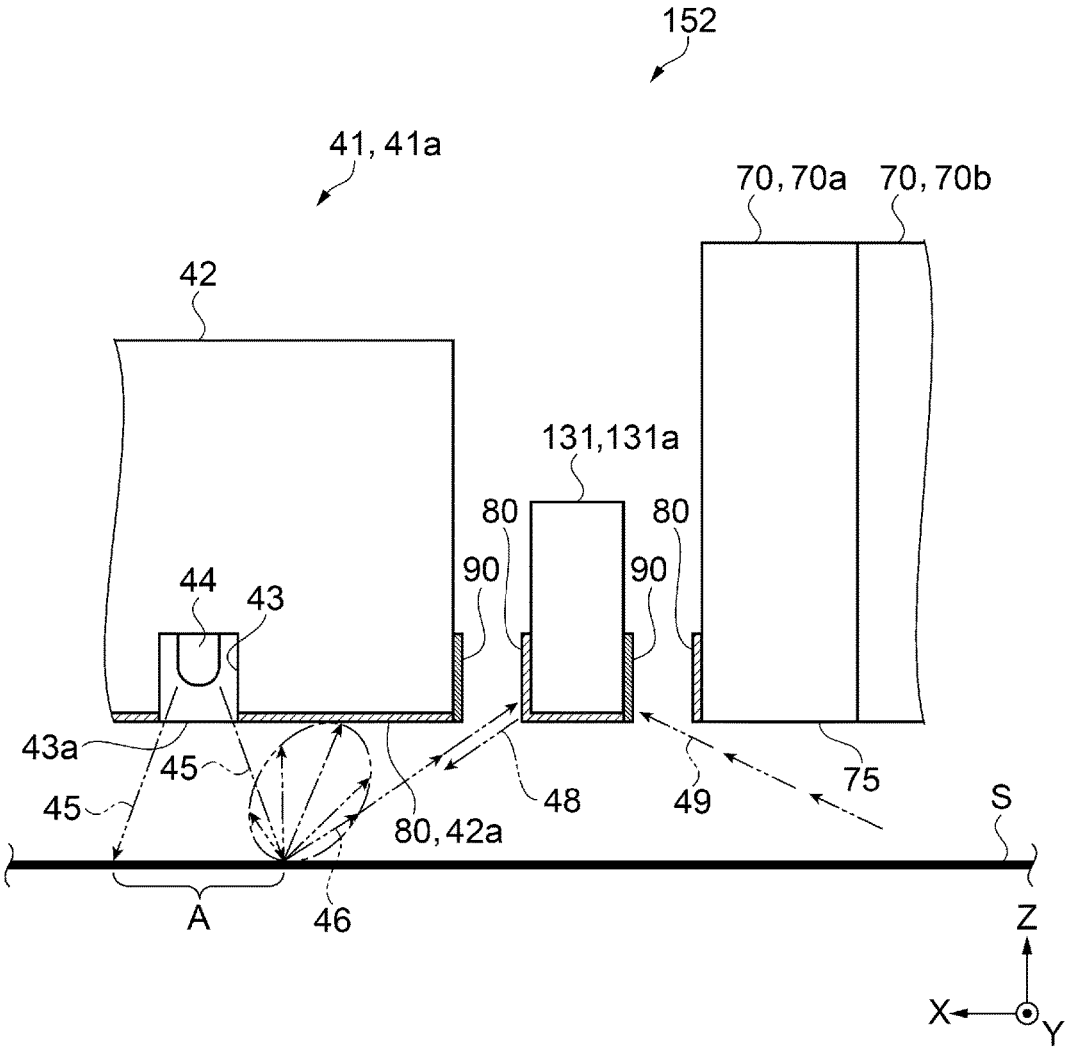
FIG. 9 is a side view illustrating a main part of the head unit in an enlarged manner.

FIG. 8 is a side view illustrating the configuration of a head unit according to a second embodiment. FIG. 9 is a side view illustrating a main part of the head unit in an enlarged manner. It should be noted that in FIG. 9, light propagation images are indicated by arrows with two-dot chain lines.

A recording apparatus 110 in the embodiment is described with reference to the drawings. The same reference numerals denote the same constituent sites as those in the first embodiment and overlapped description thereof is omitted.

As illustrated in FIG. 8 and FIG. 9, a head unit 152 includes the six heads 70 (70*a* to 70*f*), the two light irradiation units 41 (41*a* and 41*b*), and two shielding portions 131 (131*a* and 131*b*), and is supported on the carriage 55. The shielding portions 131 are provided in the light arrival region from one end side (−X-axis side) of the light irradiation unit 41*b* to the other end side (+X-axis side) of the light irradiation unit 41*a*, and reduce light directing toward the nozzle formation surfaces 75. The shielding portions 131*a* and 131*b* have plate-like rectangular parallelepiped shapes and the lengths of the shielding portions 131 in the Y-axis direction are set to substantially the same lengths of the heads 70 and the light irradiation units 41. The heights of the lower ends (at the −Z-axis side) of the shielding portions 131 are set to be equal to or slightly lower than those of the heads 70 and the light irradiation units 41. In the embodiment, the shielding portion 131*a* is arranged between the light irradiation unit 41*a* and the head 70*a* and the shielding portion 131*b* is arranged between the light irradiation unit 41*b* and the head 70*f*. With this, the amount of the light emitted from each of the light irradiation units 41*a* and 41*b* and curing the photocurable ink, which arrives at the nozzle formation surfaces 75, can be reduced.

The retroreflection surfaces 80 are provided on at least a part of surfaces opposing the light irradiation units 41 in regions interposed between the light irradiation units 41 and the heads 70. To be specific, the retroreflection surfaces 80 are provided on the side wall of the shielding portion 131*a* at the +X-axis side and the side wall of the head 70*a* at the +X-axis side, which oppose the light irradiation unit 41*a* located at the +X-axis side in the +X-axis direction. Although not illustrated in the drawings, the retroreflection surfaces 80 are also provided on the side wall of the shielding portion 131*b* at the −X-axis side and the side wall of the head 70*f* at the −X-axis side, which oppose the light irradiation unit 41*b* located at the −X-axis side in the −X-axis direction. Furthermore, the retroreflection surfaces 80 are also provided on the bottom surfaces of the shielding portions 131*a* and 131*b*, which oppose the recording medium S.

When the light such as the medium reflected light 46, which has been emitted from the light source 44 of the light irradiation unit 41*a* and is irregularly reflected (scattered) by the surface of the recording medium S, arrives at the side walls of the shielding portion 131*a* and the head 70*a* at the +X-axis side, the scattered light and the light after being repeatedly reflected can further direct toward the nozzle formation surfaces 75. However, in the embodiment, the retroreflection surfaces 80 are provided on the side walls of the shielding portion 131*a* and the head 70*a* at the +X-axis side. Therefore, the light that has arrived at each of the side walls of the shielding portion 131*a* and the head 70*a* at the +X-axis side is converted into the retroreflected light 48 by the retroreflection surface 80 and is returned to the incident direction. That is to say, the incident light that has been emitted from the light source 44 is returned to the light source 44 side. Therefore, the amount of the light for curing the photocurable ink, which arrives at the nozzle formation surfaces 75, can be reduced.

Light absorbing surfaces 90 which absorb light are provided on at least a part of surfaces opposing the heads 70 in the X-axis direction. To be specific, the light absorbing surfaces 90 are provided on the side wall of the shielding portion 131*a* at the −X-axis side and the side wall of the light irradiation unit 41*a* at the −X-axis side, which oppose the head 70*a* in the X-axis direction. Although not illustrated in the drawings, the light absorbing surfaces 90 are also provided on the side wall of the shielding portion 131*b* at the +X-axis side and the side wall of the light irradiation unit 41*b* at the +X-axis side, which oppose the head 70*f* in the X-axis direction.

The light absorbing surfaces 90 in the embodiment are formed by applying light-absorbing resin. The light-absorbing resin is made by adding, for example, carbon black or the like as an absorption coloring matter which absorbs light to acrylic resin, urethane resin, or the like. It should be noted that the light absorbing surfaces 90 may be formed by bonding light-absorbing sheets. As the light-absorbing sheets, for example, "Spectral Black" manufactured by ACKTAR Ltd., and the like, has been known.

The scattered light of the light emitted from the light source 44 of the light irradiation unit 41*b* and leaked light 49 after the light is repeatedly reflected and passes through between the heads 70 and the recording medium S possibly arrive at the side wall of the shielding portion 131*a* at the −X-axis side and the side wall of the light irradiation unit 41*a* at the −X-axis side. If the retroreflection surfaces are provided on the side wall of the shielding portion 131*a* at the −X-axis side and the side wall of the light irradiation unit 41*a* at the −X-axis side, the leaked light 49 is converted into retroreflected light and is returned to the side of the heads 70, again. This causes the risk that the amount of the light which arrives at the nozzle formation surfaces 75 is increased to enhance discharge failure of the nozzles. In the embodiment, the light absorbing surfaces 90 are provided on the side wall of the shielding portion 131*a* at the −X-axis side and the side wall of the light irradiation unit 41*a* at the −X-axis side. With this, light energy of the leaked light 49 that has arrived at the light absorbing surface 90 from the side of the heads 70 for some reasons attenuates. Therefore, the amount of the light for curing the photocurable ink, which arrives at the nozzle formation surfaces 75, can be reduced.

As described above, the recording apparatus 110 in the embodiment can provide the following effects.

The recording apparatus 110 includes the shielding portions 131 that reduce the light directing toward the nozzle formation surfaces 75 between the light irradiation units 41 and the heads 70 in the light arrival region. This can reduce the amount of the light which has been emitted from the light irradiation unit 41*a* or 41*b* and arrives at the nozzle formation surfaces 75.

Furthermore, the retroreflection surfaces 80 are provided on the surfaces (side walls) of the heads 70 and the shielding portions 131, which oppose the light irradiation units 41. The light that has arrived at each of the side walls of the shielding portions 131 and the heads 70 from any of the light sources 44 side is converted into the retroreflected light 48 returning to the light source 44 side by the retroreflection surface 80. Therefore, reflection to the side of the heads 70 is reduced so as to reduce the amount of the light for curing the photocurable ink, which arrives at the nozzle formation surfaces 75. This reduction can suppress discharge failure caused by curing of the photocurable ink which has adhered to the nozzles 72 formed in the nozzle formation surfaces 75. Accordingly, the recording apparatus 110 with improved discharge stability can be provided.

In addition, the light absorbing surfaces 90 are provided on the surfaces (side walls) of the light irradiation units 41 and the shielding portions 131, which oppose the heads 70. Energy of the light which has arrived at each of the side walls of the light irradiation units 41 and the shielding portions 131 attenuates by the light absorbing surface 90. Therefore, reflection to the side of the heads 70 is reduced so as to reduce the light amount of the light for curing the photocurable ink, which arrives at the nozzle formation surfaces 75.

This application claims priority under 35 U.S.C. § 119 to Japanese Patent Application No. 2016-156220, filed Aug. 9, 2016. The entire disclosure of Japanese Patent Application No. 2016-156220 is hereby incorporated herein by reference.

What is claimed is:

1. A recording apparatus comprising:

a light irradiation unit configured to emit light for curing photocurable ink on a recording medium; and a head having a nozzle formation surface in which nozzles for discharging the photocurable ink onto the recording medium are formed, wherein a retroreflection surface is provided on at least a part of a light arrival region at which the light emitted from the light irradiation unit arrives.

2. The recording apparatus according to claim 1, wherein a shielding portion is provided in the light arrival region to reduce light incident on the nozzle formation surface.

3. The recording apparatus according to claim 2, wherein the shielding portion is arranged between the light irradiation unit and the head.

4. The recording apparatus according to claim 1, wherein the retroreflection surface is provided on at least a part of a surface opposing the light irradiation unit in a region interposed between the light irradiation unit and the head.

5. The recording apparatus according to claim 4, wherein a light absorbing surface which absorbs the light is provided on at least a part of a surface opposing the head in the interposed region.

6. The recording apparatus according to claim 1, wherein at least a part of a housing of the light irradiation unit falls within the light arrival region.

7. The recording apparatus according to claim 1, wherein the retroreflection surface is disposed between the light irradiation unit and the nozzle formation surface in an optical path of light that is emitted from the light irradiation unit and reflected by said recording medium.

8. The recording apparatus according to claim 1, wherein the retroflection surface includes one or more retroreflector elements.

9. The recording apparatus according to claim 8, wherein the retroflector elements comprise spherical glass beads.

10. The recording apparatus according to claim 8, wherein the retroflector elements comprise corner cube mirrors or corner cube prisms.

11. The recording apparatus according to claim 1, wherein the retroreflection surface is configured to reflect incident light in a direction opposite to, and in parallel with, a direction of the incident light.

12. The recording apparatus according to claim 11, wherein the retroreflection surface is configured to reflect the incident light toward the recording medium.

* * * * *